United States Patent [19]

Dost

[11] Patent Number: 4,490,856

[45] Date of Patent: Jan. 1, 1985

[54] SWIM SUIT CONSTRUCTION

[76] Inventor: Carole Dost, 118 Madison Ave., New York, N.Y. 10016

[21] Appl. No.: 529,599

[22] Filed: Sep. 6, 1983

[51] Int. Cl.[3] ..... A41D 5/00; A41B 9/00

[52] U.S. Cl. ..... 2/67; 2/400; 2/238

[58] Field of Search ..... 2/67, 74, 400, 238, 2/402, 406, 75, 89, 74; D24/49; 112/121.26

[56] References Cited

U.S. PATENT DOCUMENTS

| | | | |
|---|---|---|---|
| 1,462,279 | 7/1923 | Guinzburg | 2/400 |
| 2,266,538 | 12/1941 | Evans | 112/121.26 |

OTHER PUBLICATIONS

Applicants search included 2/74, 75, 89, 67, 402, 406.

| | | | |
|---|---|---|---|
| 2,355,404 | 8/1944 | Virden et al. | 2/67 |
| 2,651,780 | 9/1953 | Miller . | |
| 2,987,737 | 6/1961 | Brenner . | |
| 3,243,824 | 4/1966 | Overholt . | |

*Primary Examiner*—Doris L. Troutman

*Attorney, Agent, or Firm*—Charles E. Temko

[57] ABSTRACT

A double triangle type swim suit having an elastic crotch portion to provide improved fit and appearance by preventing curling of the edges in the crotch area.

2 Claims, 2 Drawing Figures

SWIM SUIT CONSTRUCTION

BACKGROUND OF THE INVENTION

This invention relates generally to the field of female swim suits, and more particularly to an improved suit construction of a type comprising a pair of triangularly shaped panels which are adapted to be worn in a variety of configurations. Suits of this general type are known in the art, and the invention lies in specific constructional details which permit an improved fit and appearance.

Typical of the prior art is the disclosure in the U.S. patent to Virden, et al., No. 2,355,404, dated Aug. 8, 1944. This construction discloses two triangularly shaped panels, one corner of each of which is truncated, and interconnected along a transversely extending line several inches in length, extending transversely with respect to the principal axis on the suit, the interconnected area forming a part of the crotch portion of the garment when worn. While knitted type fabrics suitable for swim wear were well known at the time of the making of the Virden, et al. invention, the use of Lycra type fabrics was not, which diminished the utility of the Virden garment owing to the fact that the degree of stretch and direction of stretch in the individual triangular panels was not available. With the development of improved stretch type fabrics, it has become possible to wear garments of this type in as many as twenty different arrangements, a single size garment fitting many sizes of wearers.

Unfortunately, Lycra type fabrics, under tension, tend to curl the edges of the panel causing a less than satisfactory appearance, and in some cases, such as the crotch area, a source of embarrassment to the wearer. While the fabric from which the garment is made has a high degree of stretch, under tension the stretch is usually not transmitted along the edges of the panels, resulting in a tendency for these edges to curl inwardly resulting in an unsightly appearance and a narrowing of the effective width of the crotch area.

BRIEF SUMMARY OF THE INVENTION

Briefly stated, the invention contemplates the provision of an improved garment of the class described formed of fabrics which can be stretched in all directions, in which the tendency of the edges to curl in the crotch area has been substantially eliminated. To this end, there is provided a pair of lengths of additional elastic strips at the opposed edges of the interconnected garment panels on each side of the crotch area, which are sewn to the edges under tension causing approximately 10 to 15 percent elongation of the effective length of the strips. When the garment is worn, the fabric forming the panels will, in conforming to the wearer, normally stretch approximately 10 to 15 percent of the original dimensions, thus eliminating the wrinkles caused by the contraction of the strips prior to donning the suit, and providing edges of the crotch area, which are under slight tension sufficient to prevent curling, but not sufficient to cause discomfort to the wearer. Because the additional tension along the edges of the panels is confined to the crotch area, no wrinkling or distortion occurs in other portions of the garment, irrespective of the manner in which it is worn.

BRIEF DESCRIPTION OF THE DRAWING

In the drawing, to which reference will be made in the specification, similar reference characters have been employed to designate the corresponding parts throughout the several views.

DETAILED DESCRIPTION OF THE DISCLOSED INVENTION

Figure 1:
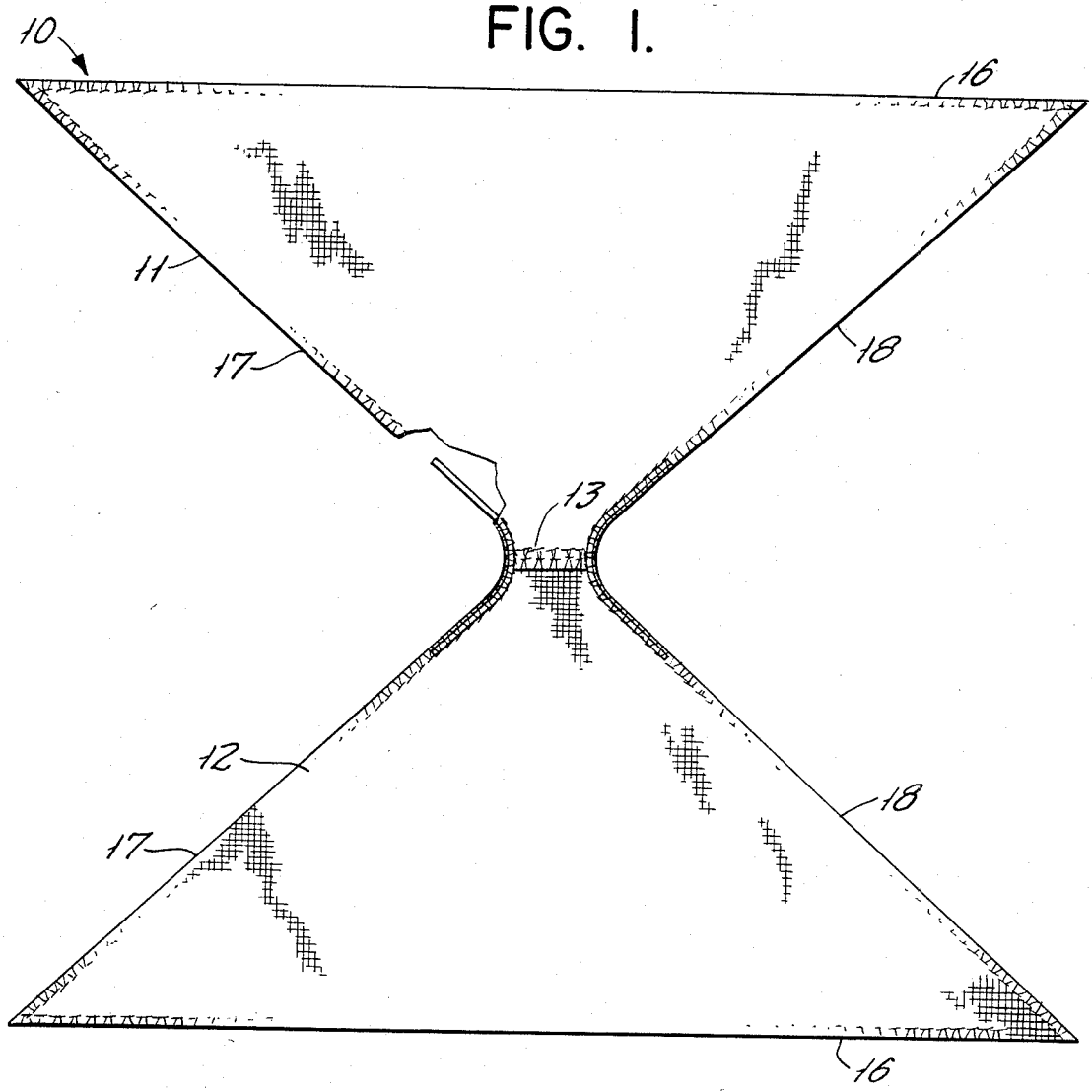
FIG. 1 is a view in elevation of an embodiment of the invention in planar or developed condition.
Figure 2:
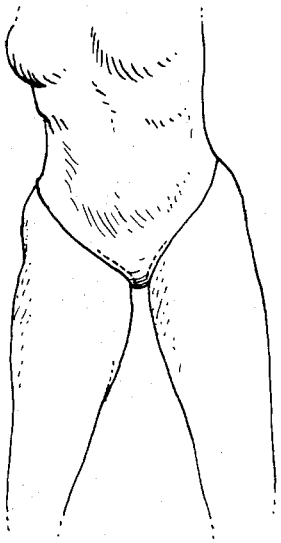
FIG. 2 is a front elevational view thereof in position upon a wearer.

In accordance with the invention, the device, generally indicated by reference character 10 comprises broadly: first and second triangular elements 11 and 12 mutually interconnected by seam means 13 and one triangular corner.

Each of the elements 11 and 12 is bounded by an outer transversed edge 16 and a pair of converging edges 17 and 18 which extend therefrom to a transversely extending interconnecting seam 13 of approximately 3" in length, when in unstressed condition. When formed from a Lycra material, the edges 16–18, inclusive, may be bound or selvedged using a conventional overlock stitch.

Using conventional knitted materials, and relatively light tensions, there is little problem of curling of the edges in the crotch area. It is possible, as in the disclosure in the abovementioned Virden, et al. patent, to provide an additional pad of rhomboid configuration to add improved stiffness to the area and prevent any tendency to narrow the crotch area. However, such provision tends to add bulk to the garment, and detract from the appearance thereof.

To prevent curling, I have added a pair of elongated elastic strips which are incorporated into the longitudinal edges of the panels 11 and 12 in the crotch area. These are preferrably approximately 9" to 10" in length, and extend in substantially equal segments into each of the triangular elements 11 and 12, being bisected by the edge seam 13. Most conveniently, they are incorporated into the edges at this point by the same overlap stitching which binds the remaining portion of the edges. This stitching is performed with the strips under tension, caused by approximately 10 to 15 percent elongation from unstressed condition. It will cause a slight puckering of the garment when it is not worn, but normally, due to stretching of the garment as soon as it is donned by approximately 10 to 15 percent, this puckering will disappear, and the crotch area remains with the elastic strips under the relatively moderate degree of tension, sufficient to prevent any tendency to curl, but not sufficient to cause discomfort. Since the strips are terminated a relatively short distance from the crotch area, the effect of tension in the strips is confined to the crotch area, and no distortion of the remaining parts of the garment occurs, other than those induced by the manner in which it is worn.

Since the tension extends parallel to the edges of the crotch area, with the wearing of the garment not only is the tendency to curl resisted, but the tendency for the crotch area to narrow under tension exerted by the tieing of the three corners of the panels 11 and 12 is also resisted, the result being that the crotch area comfortably conforms to the contour of the wearer at this point.

I wish it to be understood that I do not consider the invention limited to the precise details of structure shown and set forth in this specification, for obvious modifications will occur to those skilled in the art to which the invention pertains:

I claim:

1. In a swim suit construction including a pair of generally triangularly-shaped panels interconnection substantially at one triangular corner thereof, said panels being formed of a fabric capable of substantial stretch in either of two mutually perpendicular directions, said panels being interconnected by a short transversely extending seam to define a crotch area when said construction is worn, the improvement comprising: a pair of elongate elastic strips interconnected to the free side edges of each of said panels in said crotch area to extend on either side of said transverse seam; said strips being sewn under tension to said panel edges under approximately 10 to 15 percent elongation from unstressed conditions; whereby when said garment is worn, the normal tension applied to said panels during wearing will place a moderate degree of tension upon the edges in said crotch area sufficient to prevent lateral curling thereof.

2. The improvement in accordance with claim 1, said elongate elastic strips being approximately 9" to 10" in length, and being bisected by said seam.

* * * * *